US009112268B2

(12) United States Patent
Tanabe

(10) Patent No.: US 9,112,268 B2
(45) Date of Patent: Aug. 18, 2015

(54) SPIRAL ANTENNA

(71) Applicant: KABUSHIKI KAISHA TOSHIBA, Tokyo (JP)

(72) Inventor: Masahiro Tanabe, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 198 days.

(21) Appl. No.: 13/746,692

(22) Filed: Jan. 22, 2013

(65) Prior Publication Data

US 2014/0028528 A1 Jan. 30, 2014

(30) Foreign Application Priority Data

Jul. 25, 2012 (JP) ..... 2012-164567

(51) Int. Cl.
*H01Q 1/36* (2006.01)
*H01Q 9/27* (2006.01)

(52) U.S. Cl.
CPC ... *H01Q 9/27* (2013.01); *H01Q 1/36* (2013.01)

(58) Field of Classification Search
USPC ..... 343/895
See application file for complete search history.

(56) References Cited

U.S. PATENT DOCUMENTS

| | | | | |
|---|---|---|---|---|
| 3,374,483 | A | 3/1968 | Fenwick | |
| 3,778,839 | A | 12/1973 | Kovar | |
| 5,220,340 | A * | 6/1993 | Shafai | 343/895 |
| 5,619,218 | A * | 4/1997 | Salvail et al. | 343/895 |
| 5,646,633 | A * | 7/1997 | Dahlberg | 343/700 MS |
| 6,067,058 | A | 5/2000 | Volman | |
| 6,300,919 | B1 | 10/2001 | Mehen et al. | |
| 7,701,408 | B2 * | 4/2010 | Bombay et al. | 343/841 |
| 8,056,819 | B2 * | 11/2011 | Rowell et al. | 235/492 |
| 2004/0027308 | A1 | 2/2004 | Lynch et al. | |

FOREIGN PATENT DOCUMENTS

| | | |
|---|---|---|
| JP | 2000-252738 | 9/2000 |
| JP | 2013-74409 | 4/2013 |

OTHER PUBLICATIONS

Extended European Search Report issued on Dec. 11, 2013 in a counterpart European Application No. 13152354.0.
Japanese Office Action issued Jun. 3, 2014, in Japan Patent Application No. 2012-164567 (with English translation).
B. A. Kramer, et al., "Size Reduction of a Low-Profile Spiral Antenna Using Inductive and Dielectric Loading", IEEE Antennas and Wireless Propagation Letters, vol. 7, 2008, 4 pages.
Christos Kinezos, et al., "Ultra-wideband Circular Polarized Microstrip Archimedean Spiral Antenna Loaded with Chip-resistor", IEEE, 2003, 4 pages.
J. T. Bernhard, "Compact Single-Arm Square Spiral Microstrip Antenna with Tuning Arms", IEEE, 2001, 4 pages.

* cited by examiner

*Primary Examiner* — Tan Ho
(74) *Attorney, Agent, or Firm* — Oblon, McClelland, Maier & Neustadt, L.L.P.

(57) ABSTRACT

According to one embodiment, a spiral antenna includes at least one spiral arm and a connection portion which connects an end of the spiral arm to an adjacent spiral arm.

3 Claims, 19 Drawing Sheets

SPIRAL ANTENNA

CROSS-REFERENCE TO RELATED APPLICATIONS

This application is based upon and claims the benefit of priority from Japanese Patent Application No. 2012-164567, filed Jul. 25, 2012, the entire contents of which are incorporated herein by reference.

FIELD

Embodiments described herein relate generally to a spiral antenna having broadband characteristics.

BACKGROUND

Although a spiral antenna has broadband characteristics, its lowest frequency is limited by its outer shape. To obtain satisfactory antenna characteristics (gain and axial ratio) at the lowest frequency, it is known to increase the outer shape size of the antenna, add a wave absorber and the like, deform the shape of an end portion, or add an absorption resistance and the like.

DETAILED DESCRIPTION

In general, according to one embodiment, a spiral antenna includes at least one spiral arm and a connection portion which connects an end of said spiral arm to an adjacent spiral arm.

A spiral antenna according to the embodiment will be described below with reference to the accompanying drawings.

Figure 1:
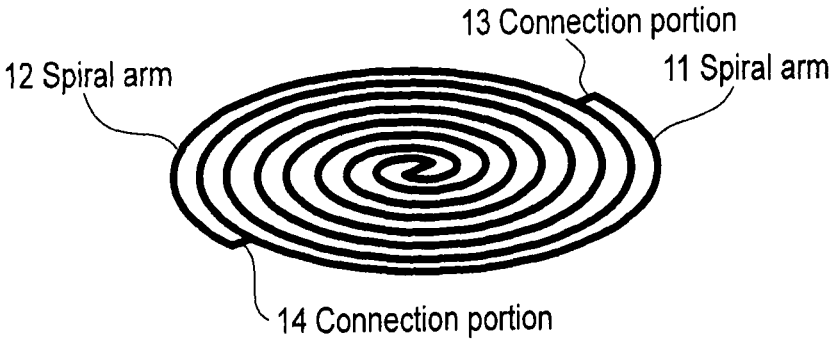
FIG. 1 is a perspective view showing a spiral antenna according to an embodiment.
Figure 2:
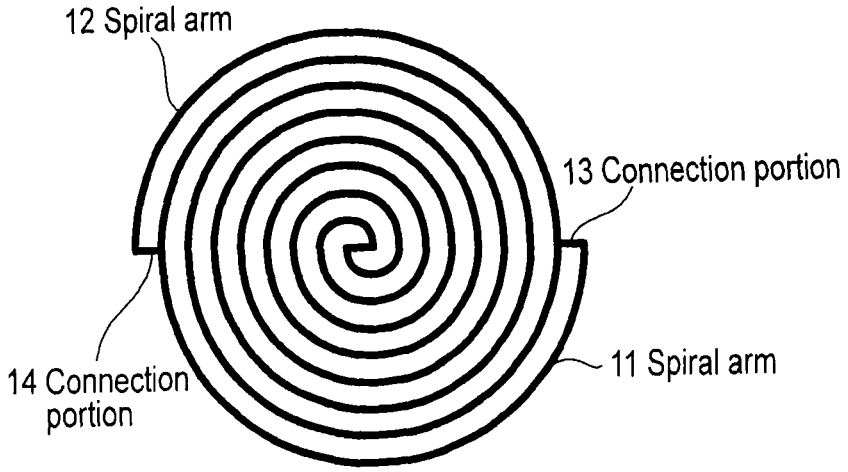
FIG. 2 is a plan view showing the spiral antenna shown in FIG. 1.

FIG. 1 is a perspective view showing a spiral antenna according to the embodiment. FIG. 2 is a plan view showing the spiral antenna shown in FIG. 1.

The spiral antenna includes, for example, two spiral arms 11 and 12, and connection portions 13 and 14 for respectively connecting the ends of the spiral arms 11 and 12 to adjacent arms. The spiral arms 11 and 12 can be formed by a strip antenna for which a pattern is formed by etching a metal substrate as shown in FIG. 1, or can be formed by winding a wire (metal wire). As shown in FIG. 1, for example, the connection portions 13 and 14 are used to electrically connect the spiral arms 11 and 12 with bent ends to the other, adjacent spiral arms, respectively.

The operation of the spiral antenna with such an arrangement will now be described.

The operation principle of the spiral antenna can be explained by the current band theory. That is, radiation from the antenna occurs in the region where the wavelength corresponding to the operating frequency equals the outer circumference of the antenna (1 wavelength circumference). When, therefore, the outermost circumference of the spiral antenna is smaller than 1 wavelength circumference at the lowest operating frequency, radiation from the spiral antenna does not occur at that frequency. The current flowing to the spiral arms is reflected by the ends of the spiral arms, resulting in degradation of the characteristics.

Figure 3:
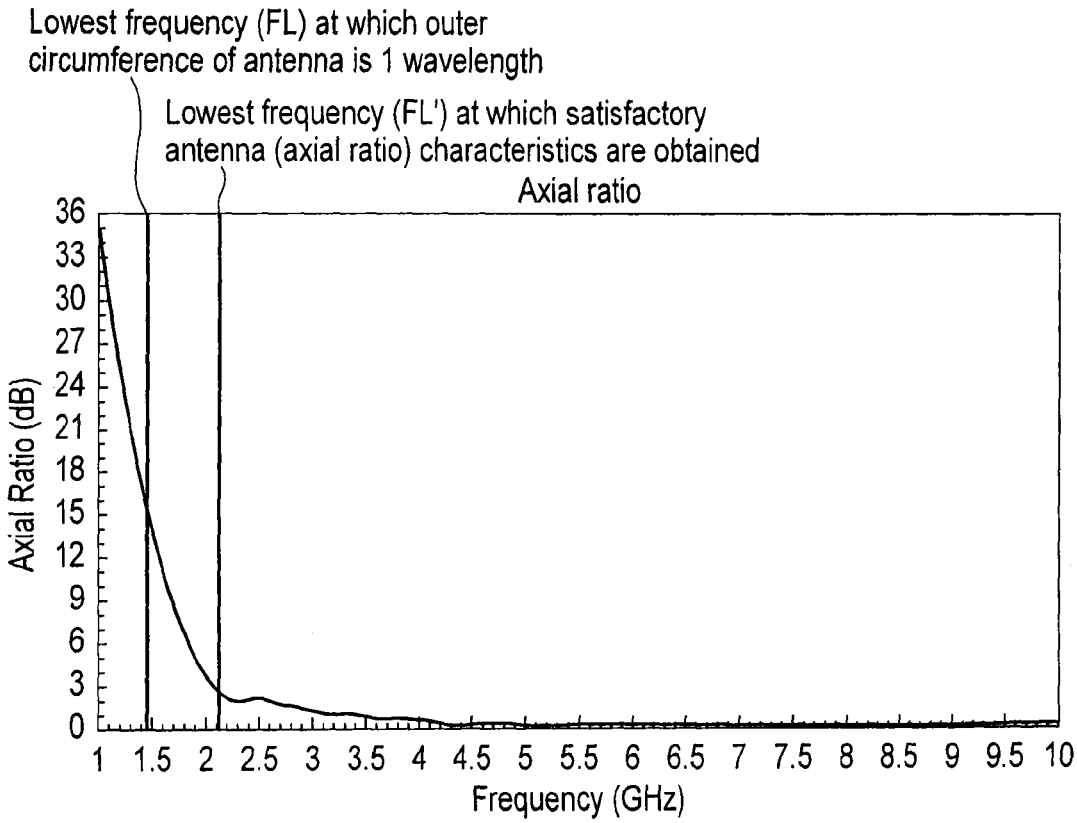
FIG. 3 is a graph showing the relationship between the frequency and axial ratio of a general spiral antenna.

FIG. 3 is a graph showing the relationship between the operating frequency and axial ratio of a general spiral antenna, in which the abscissa represents the frequency [GHz], and the ordinate represents the axial ratio [dB]. As shown in FIG. 3, the characteristics do not start degrading at the lowest frequency (denoted by reference symbol FL in FIG. 3) but gradually degrades from a high frequency (denoted by reference symbol FL' in FIG. 3). To obtain satisfactory performance at the lowest frequency, therefore, the outer circumference of the antenna needs to be large.

On the other hand, as a technique of reducing the reflected wave, it is known to provide a wave absorber to the spiral antenna. When the wave absorber absorbs the reflected wave generated at the end of each spiral arm around the lowest frequency, the characteristics improve. However, the wave absorber also absorbs radiant energy, and the antenna efficiency decreases.

In this embodiment, by providing the connection portions 13 and 14, the current at the end of one spiral arm flows to the central portion of the other spiral arm and the end of the spiral arm itself. The current flowing to the central portion of the other spiral arm has a phase opposite to that of the current flowing through the spiral arm, and is thus canceled, thereby reducing the current reflected by the end of the spiral arm. Such a simple structure can reduce the reflected wave at the end of the spiral arm, and suppress degradation in antenna performance in the lowest frequency band.

FIGS. 4A, 4B, 5A, 5B, 6A and 6B show effects obtained in the embodiment. FIGS. 4A, 4B, 5A, 5B, 6A and 6B are graphs showing current distributions on the spiral arms with and without bent ends, in which the abscissa represents the arm length from the center of the spiral to the end, the left ordinate represents the current [A], and the right ordinate represents the phase [deg]. In each graph, a solid line indicates the real part; a broken line, the imaginary part; a one-dot dashed line, the amplitude; and a dotted line, the phase.

Figure 4A:
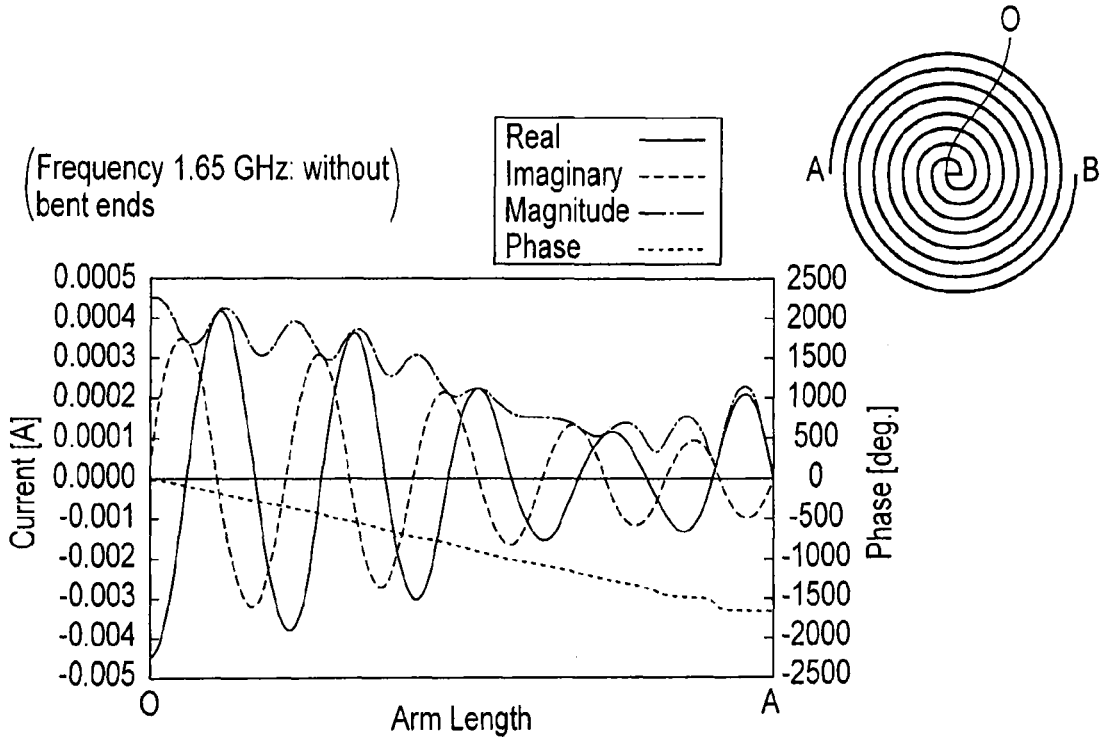
FIG. 4A is a graph showing the relationship between the arm length and the current at a frequency of 1.65 GHz without bent ends.
Figure 4B:
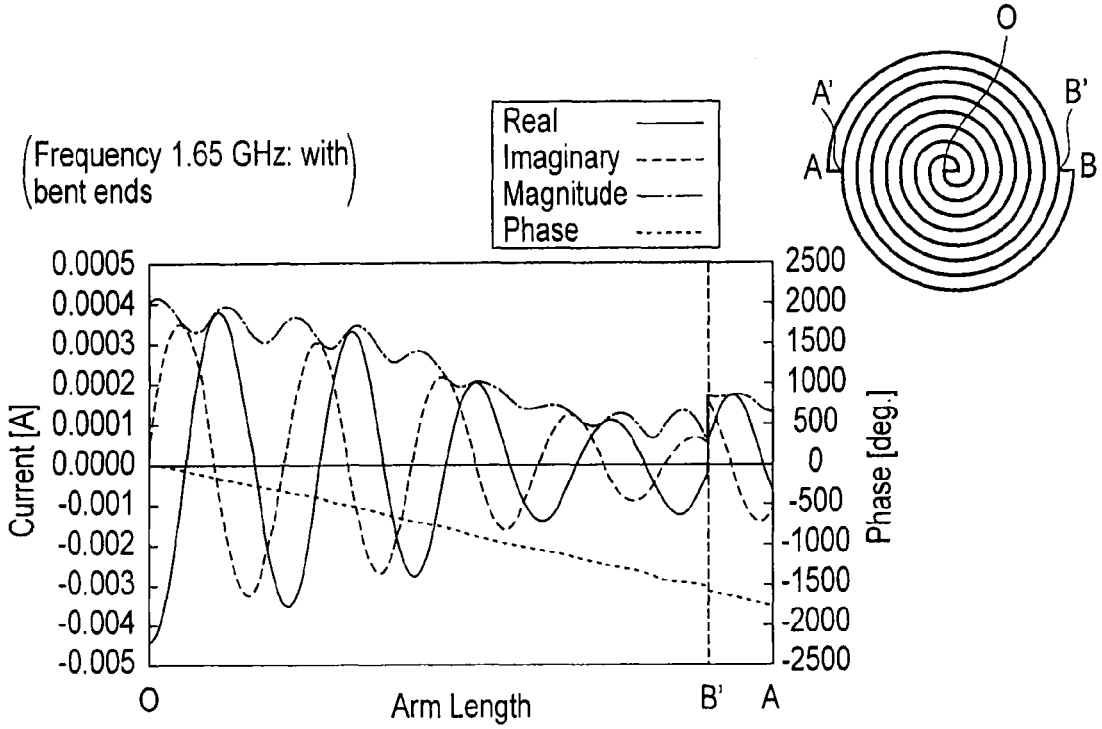
FIG. 4B is a graph showing the relationship between the arm length and the current at a frequency of 1.65 GHz with bent ends.
Figure 5A:
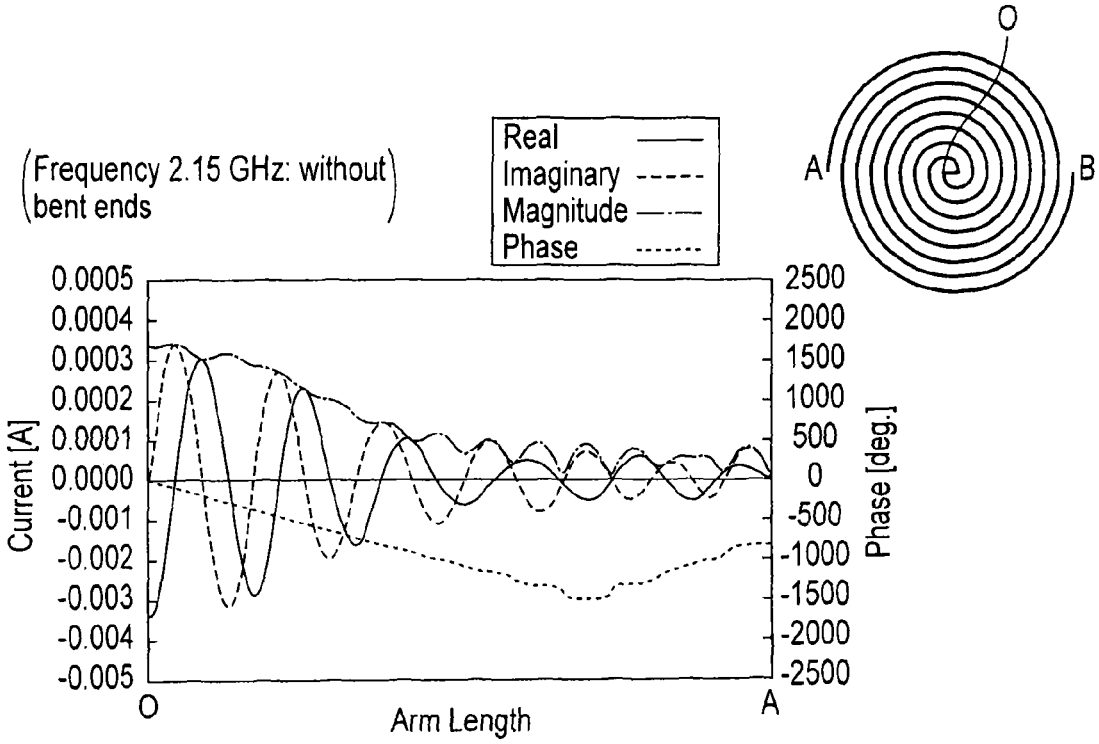
FIG. 5A is a graph showing the relationship between the arm length and the current at a frequency of 2.15 GHz without bent ends.
Figure 5B:
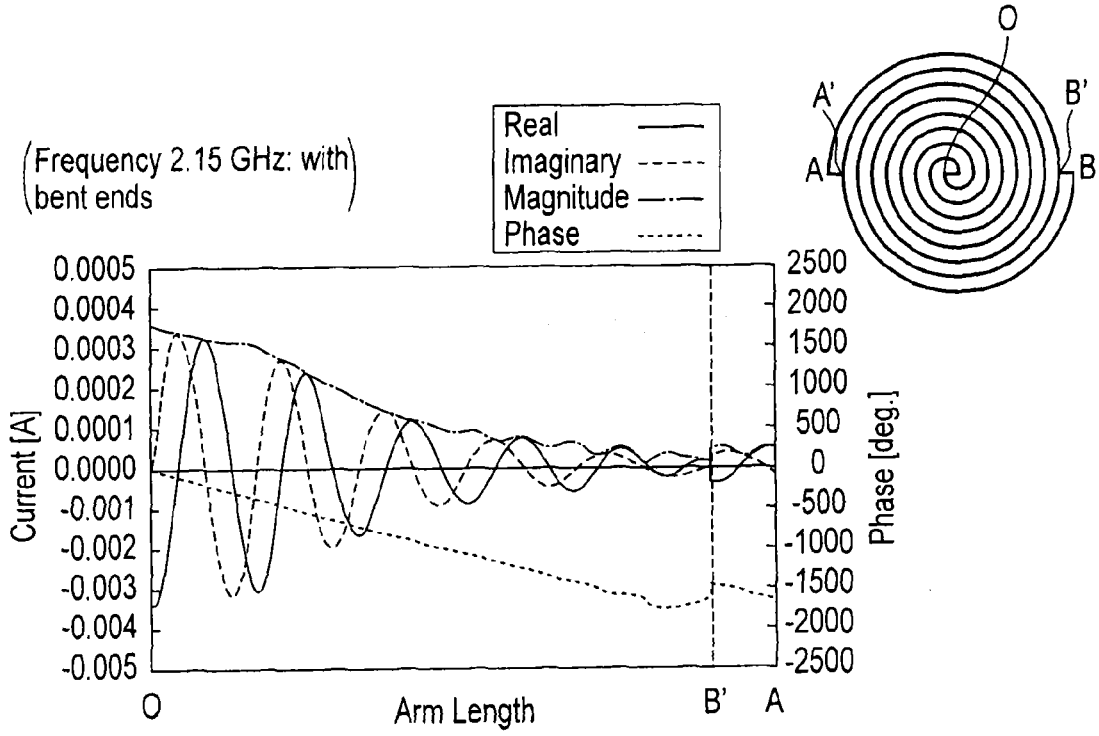
FIG. 5B is a graph showing the relationship between the arm length and the current at a frequency of 2.15 GHz with bent ends.
Figure 6A:
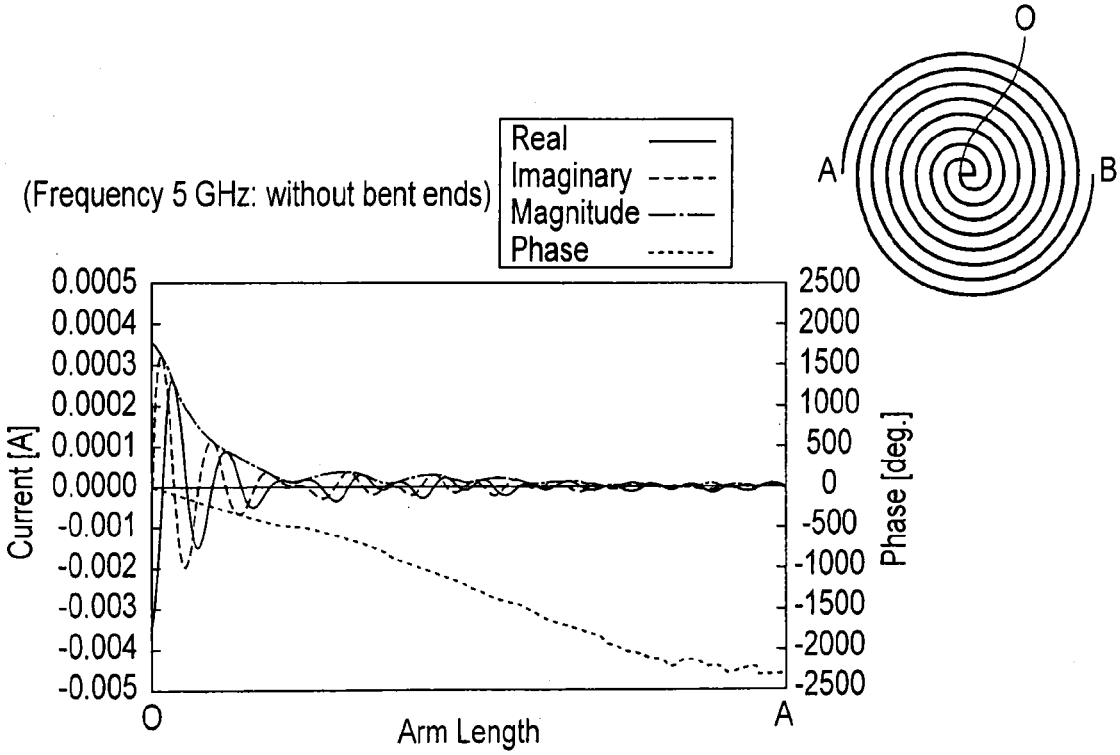
FIG. 6A is a graph showing the relationship between the arm length and the current at a frequency of 5 GHz without bent ends.
Figure 6B:
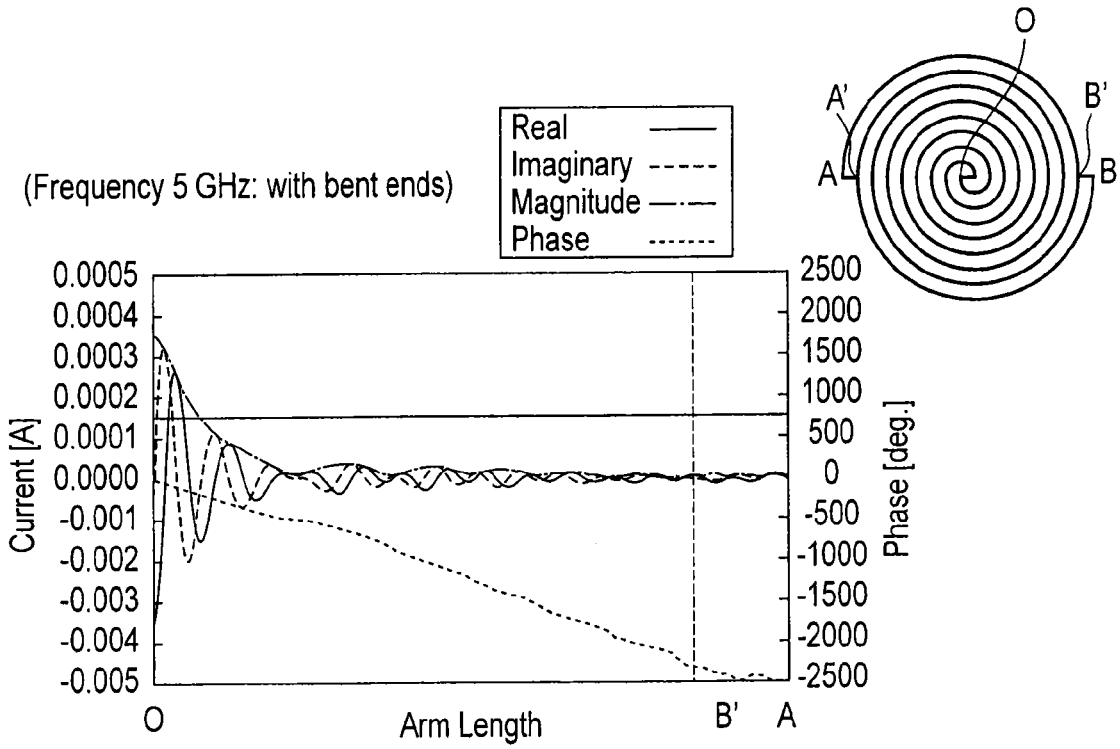
FIG. 6B is a graph showing the relationship between the arm length and the current at a frequency of 5 GHz with bent ends.

FIG. 4A is a graph at a frequency of 1.65 GHz without bent ends and FIG. 4B is a graph at a frequency of 1.65 GHz with bent ends. FIG. 5A is a graph at a frequency of 2.15 GHz without bent ends and FIG. 5B is a graph at a frequency of 2.15 GHz with bent ends. FIG. 6A is a graph at a frequency of 5 GHz without bent ends and FIG. 6B is a graph at a frequency of 5 GHz without bent ends. Note that although the spiral arms in this case are formed by not strips shown in FIG. 1 but wires, there is substantially no difference in characteristics.

Each of FIGS. 4A, 4B, 5A and 5B shows the current distribution around the lowest frequency. It will be apparent from the amplitude (one-dot dashed line) of the current distribution that the amplitude of a standing wave decreases over the whole spiral arms if the spiral arms have bent ends, as shown in FIGS. 4B and 5B. Each of FIGS. 4B and 5B also shows that the phase linearly changes. This indicates that the reflected wave is reduced and a traveling-wave current has been generated on the spiral arms. On the other hand, referring to FIGS. 6A and 6B, at a frequency (5 GHz) at which the outermost circumference of the spiral antenna is larger than 1 wavelength circumference, the same current distribution has been obtained and a traveling-wave current has been generated regardless of whether the spiral arms have bent ends.

Figure 7:
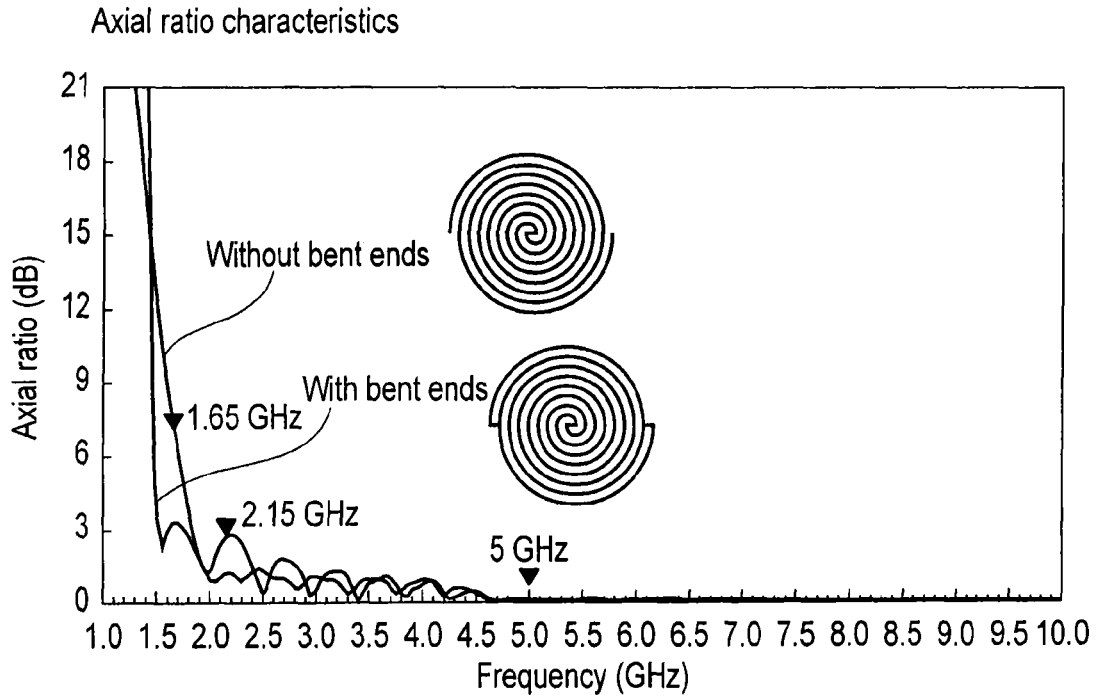
FIG. 7 is a graph showing axial ratio characteristics with and without bent ends.
Figure 8:
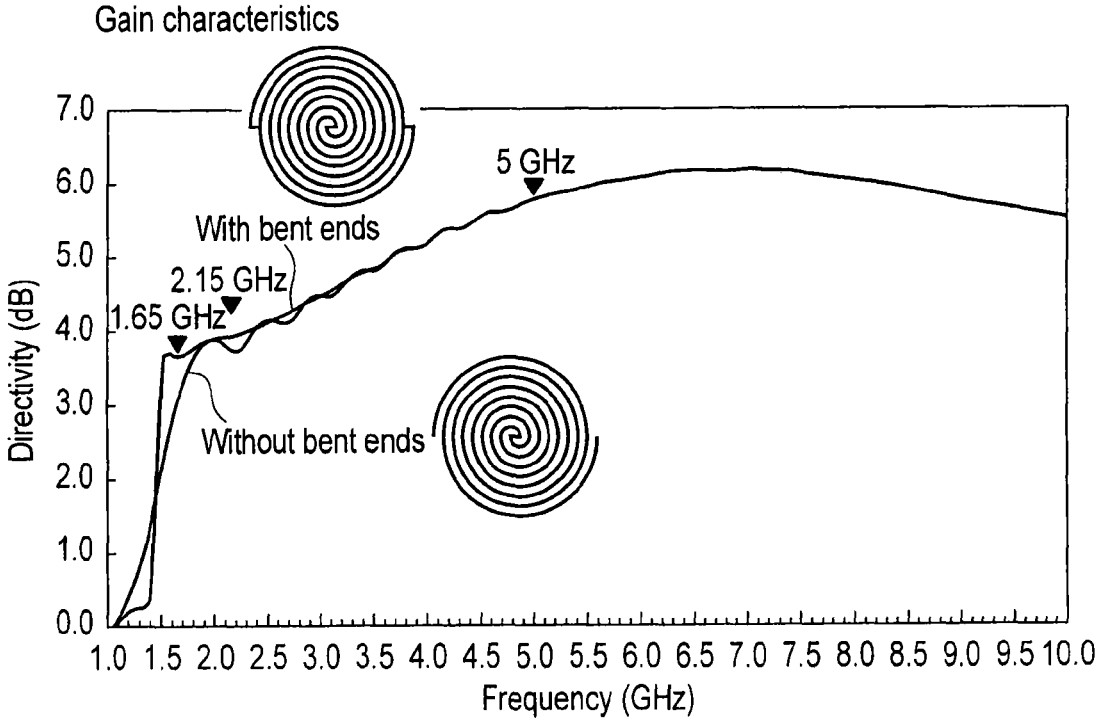
FIG. 8 is a graph showing gain characteristics with and without bent ends.

FIG. 7 is a graph showing the axial ratio characteristics, in which the abscissa represents the frequency [GHz] and the ordinate represents the axial ratio [dB]. FIG. 8 is a graph showing the gain characteristics, in which the abscissa represents the frequency [GHz] and the ordinate represents the directional gain [dB]. Referring to FIGS. 7 and 8, according to the embodiment, satisfactory axial ratio and gain characteristics are obtained even in a low frequency band.

Figure 9:
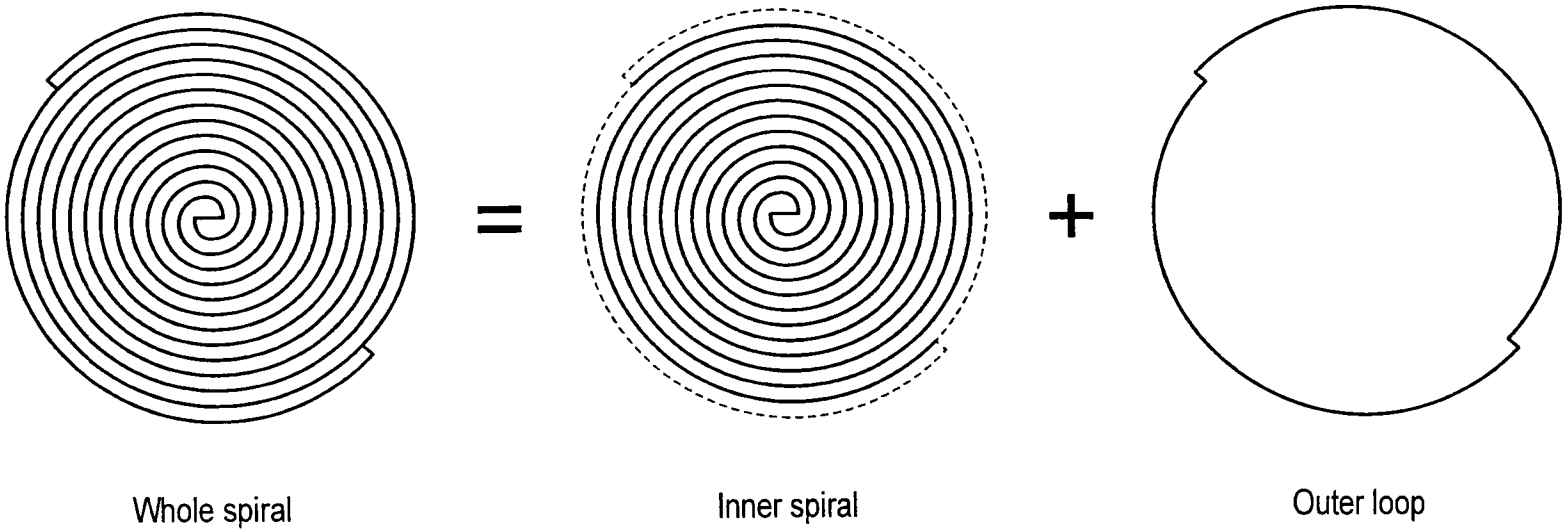
FIG. 9 is a view showing a case in which the whole radiated field from a wire spiral antenna is decomposed into respective fields according to the embodiment.

Furthermore, a practical example in which it is possible to obtain satisfactory axial ratio characteristics and gain characteristics will be described below. Although two arms are used in this example, the same principle applies to a case in which one arm is used. In this example, as shown in FIG. 9, the whole spiral radiated field is decomposed into an inner spiral radiated field and an outer loop radiated field.

Figure 10A:
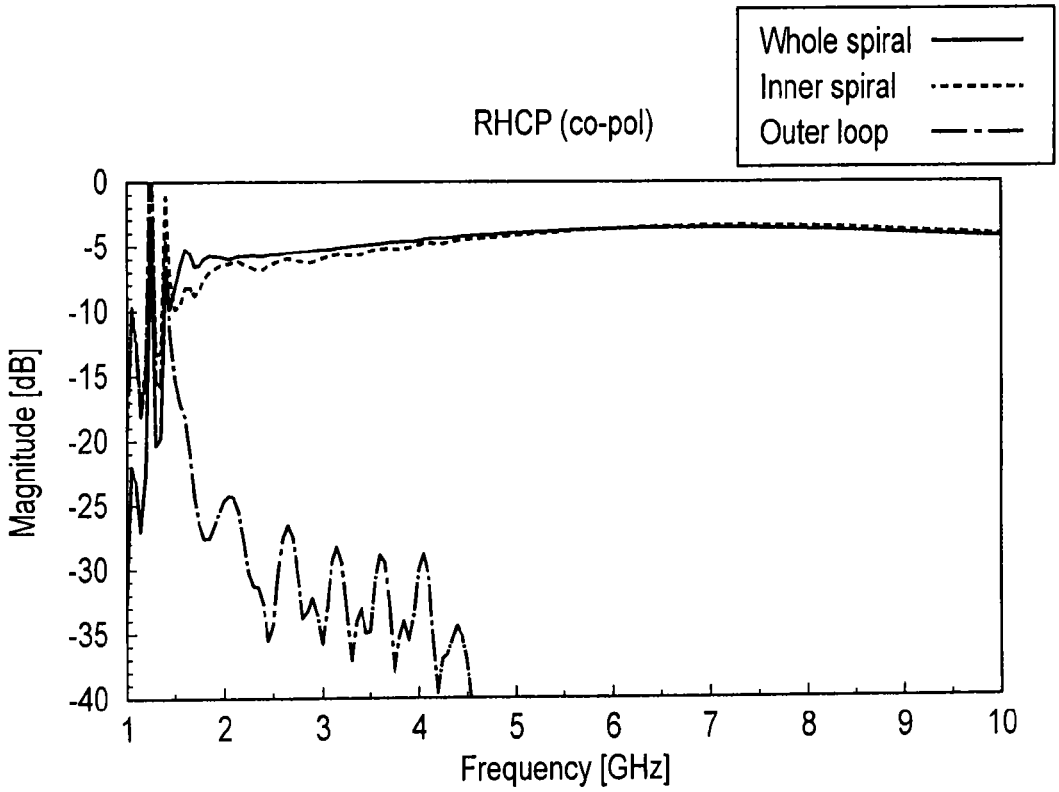
FIG. 10A is a graph showing the frequency characteristics of the amplitude of the RHCP component of each radiated field.
Figure 10B:
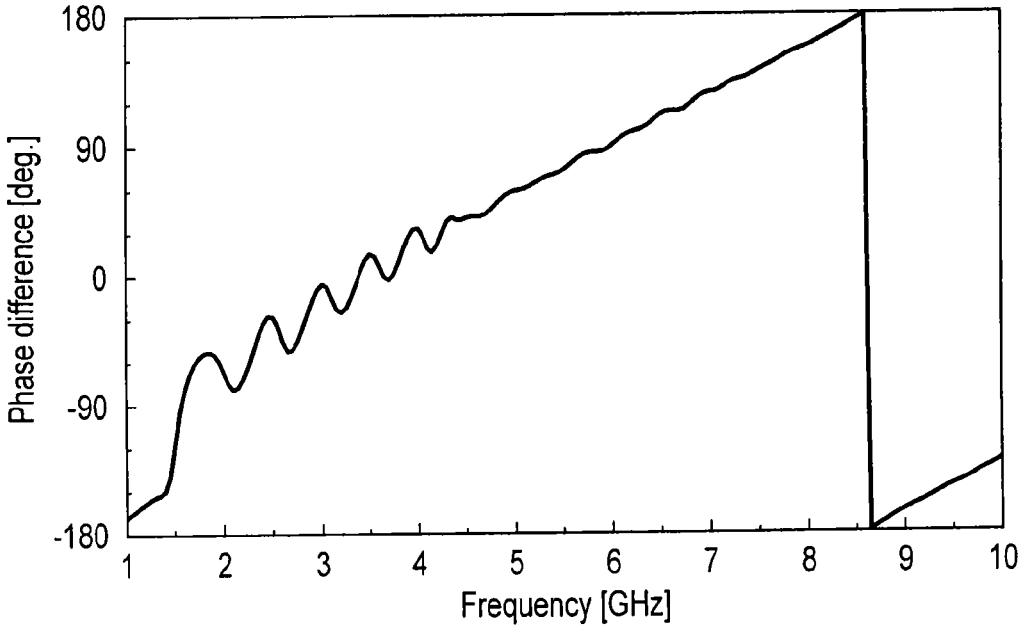
FIG. 10B is a graph showing the frequency characteristics of the phase difference between the RHCP component of an inner spiral radiated field and that of an outer loop radiated field.
Figure 11A:
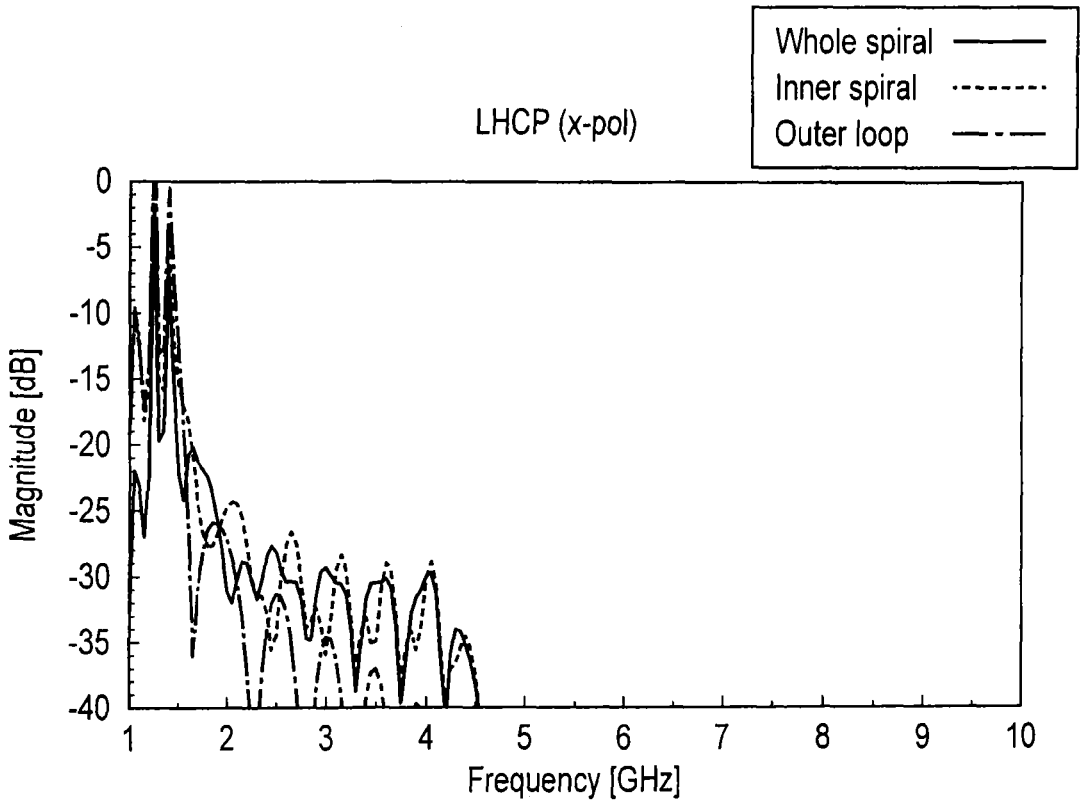
FIG. 11A is a graph showing the frequency characteristics of the amplitude of the LHCP component of each radiated field.
Figure 11B:
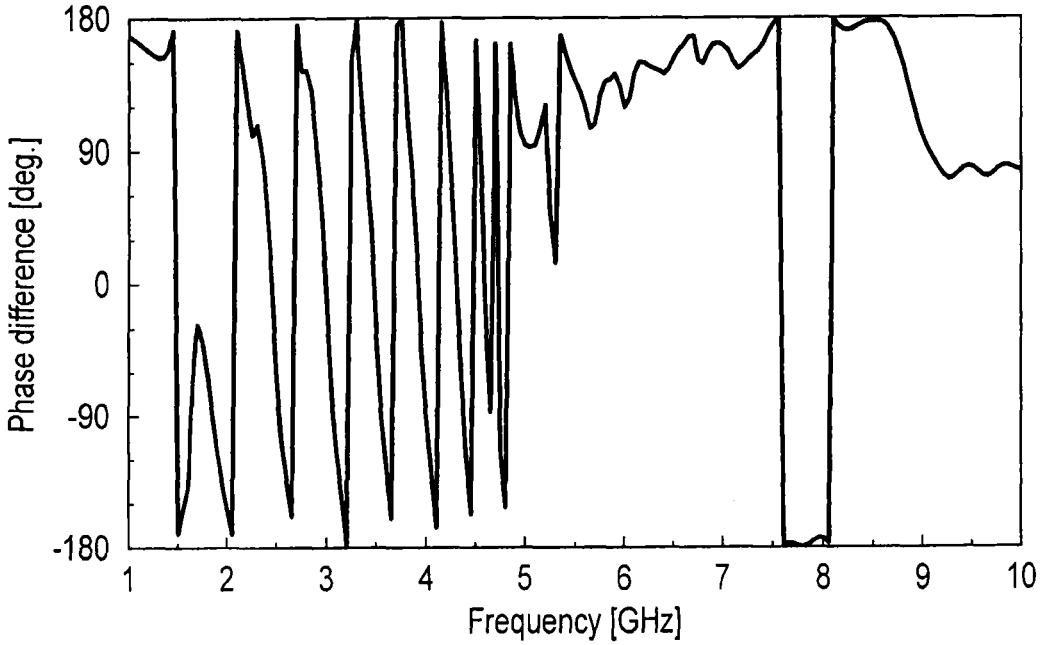
FIG. 11B is a graph showing the frequency characteristics of the phase difference between the LHCP component of the inner spiral radiated field and that of the outer loop radiated field.

FIG. 10A is a graph showing the frequency characteristics of the amplitude of the RHCP (right-handed circularly polarized wave) component of each radiated field. FIG. 10B is a graph showing the frequency characteristics of the phase difference between the outer loop radiated field and the inner spiral radiated field. FIG. 11A is a graph showing the frequency characteristics of the amplitude of the LHCP (left-handed circularly polarized wave) component of each radiated field. FIG. 11B is a graph showing the frequency characteristics of the phase difference between the outer loop radiated field and the inner spiral radiated field.

Obtaining a satisfactory axial ratio amounts to making one of the RHCP and LHCP components dominant. Note that in this embodiment, the RHCP component is dominant. Referring to FIGS. 10A and 11A, at a frequency of 1.6 GHz or higher, the inner spiral radiated field is dominant. This means that as described above, the reflected current at the ends of the spiral arms has reduced by bending the ends, and a traveling-wave current has been generated.

Figure 12A:
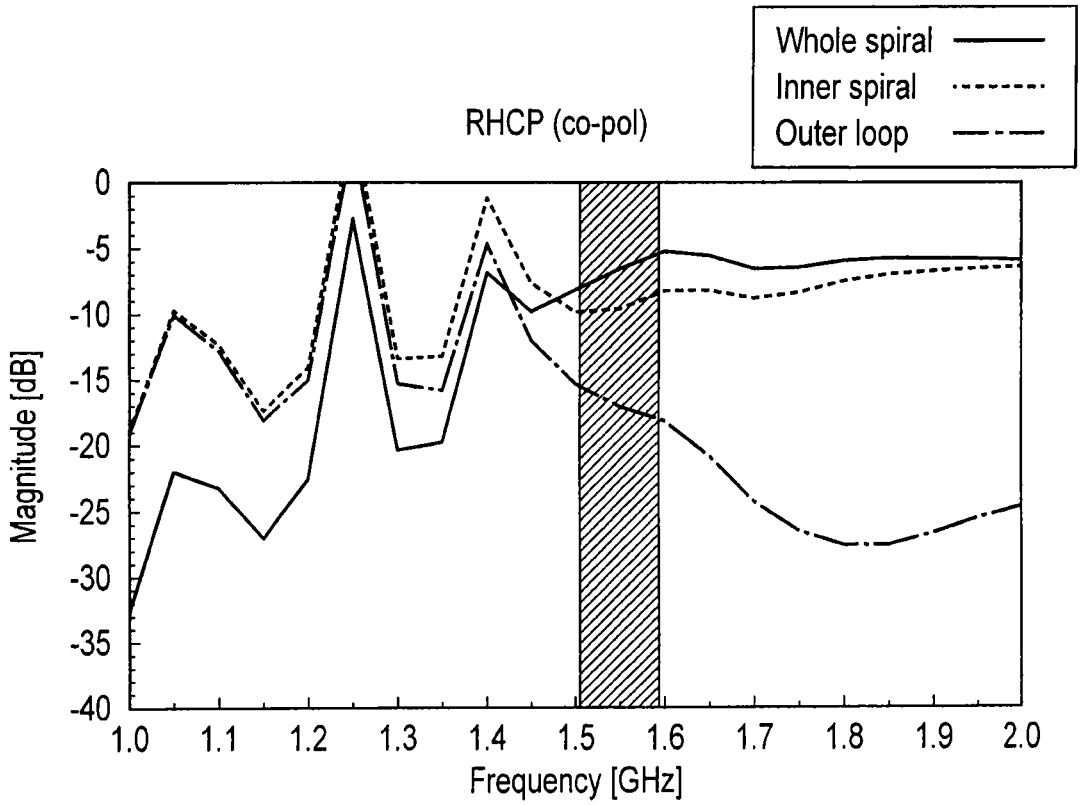
FIG. 12A is an enlarged graph showing the frequency range from 1 to 2 GHz shown in FIG. 10A.
Figure 12B:
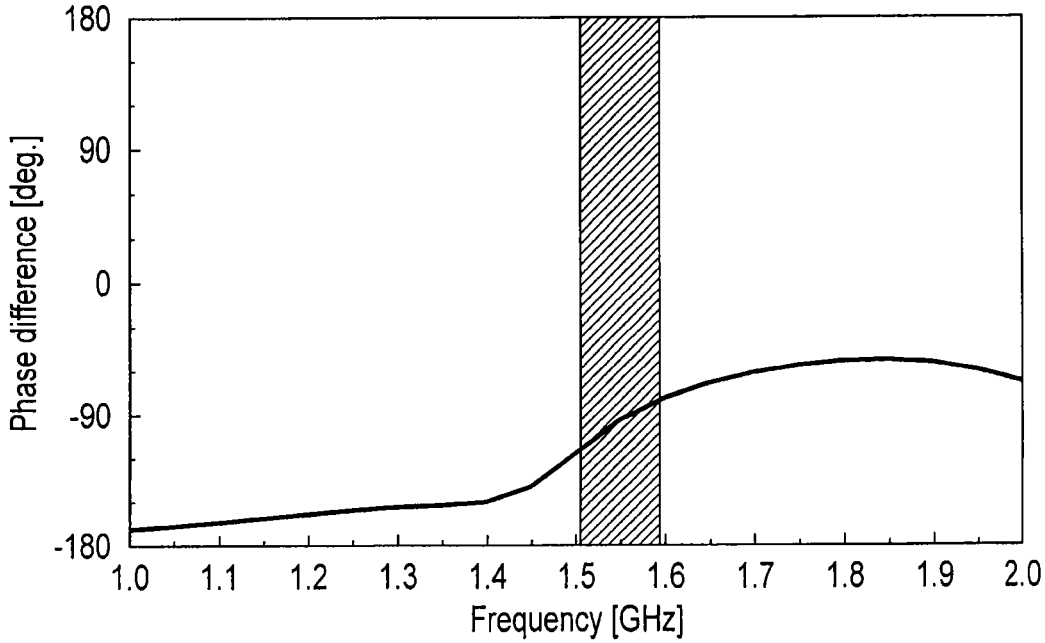
FIG. 12B is an enlarged graph showing the frequency range from 1 to 2 GHz shown in FIG. 10B.
Figure 13A:
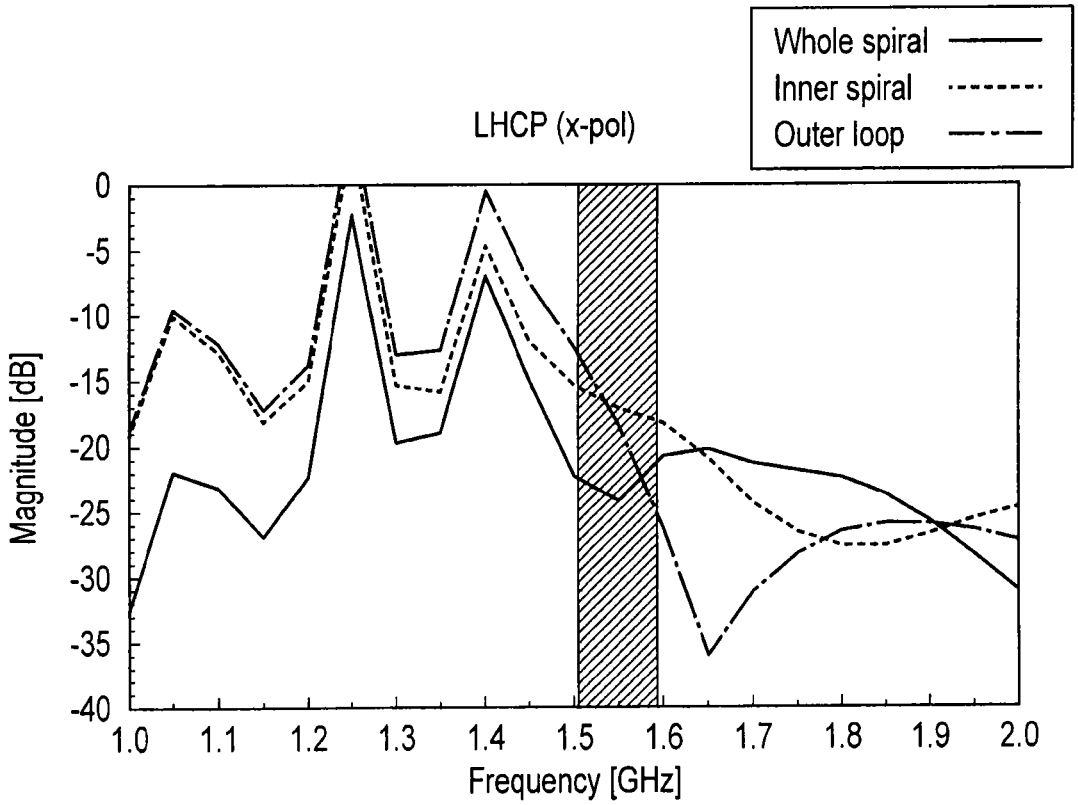
FIG. 13A is an enlarged graph showing the frequency range from 1 to 2 GHz shown in FIG. 11A.
Figure 13B:
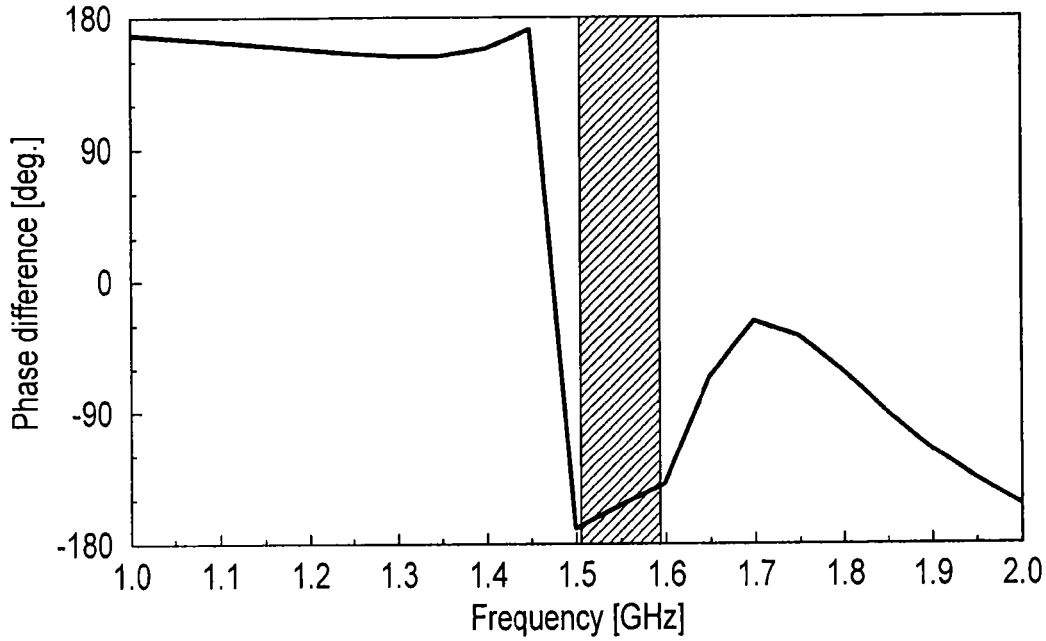
FIG. 13B is an enlarged graph showing the frequency range from 1 to 2 GHz shown in FIG. 11B.

In the frequency range from 1.5 GHz to 1.6 GHz, the spiral arms exhibit a slightly different behavior. FIGS. 12A, 12B, 13A, and 13B are enlarged graphs showing the frequency range from 1.0 GHz to 2.0 GHz shown in FIGS. 10A, 10B, 11A, and 11B, respectively. As shown in FIGS. 12A and 13A, for not only the RHCP component but also the LHCP component, the strength of the outer loop radiated field is almost equal to that of the inner spiral radiated field within the frequency range from 1.5 GHz to 1.6 GHz. Referring to FIG. 13B, however, the phase difference between the LHCP components around a frequency of 1.55 GHz is 180°. Therefore, the LHCP component of the outer loop radiated field and that of the inner spiral radiated field cancel each other in space, and the total LHCP component is suppressed. Consequently, the RHCP component becomes dominant, thereby obtaining a satisfactory axial ratio. The gain characteristics improve since the LHCP components cancel each other, as a matter of course.

Figure 14:
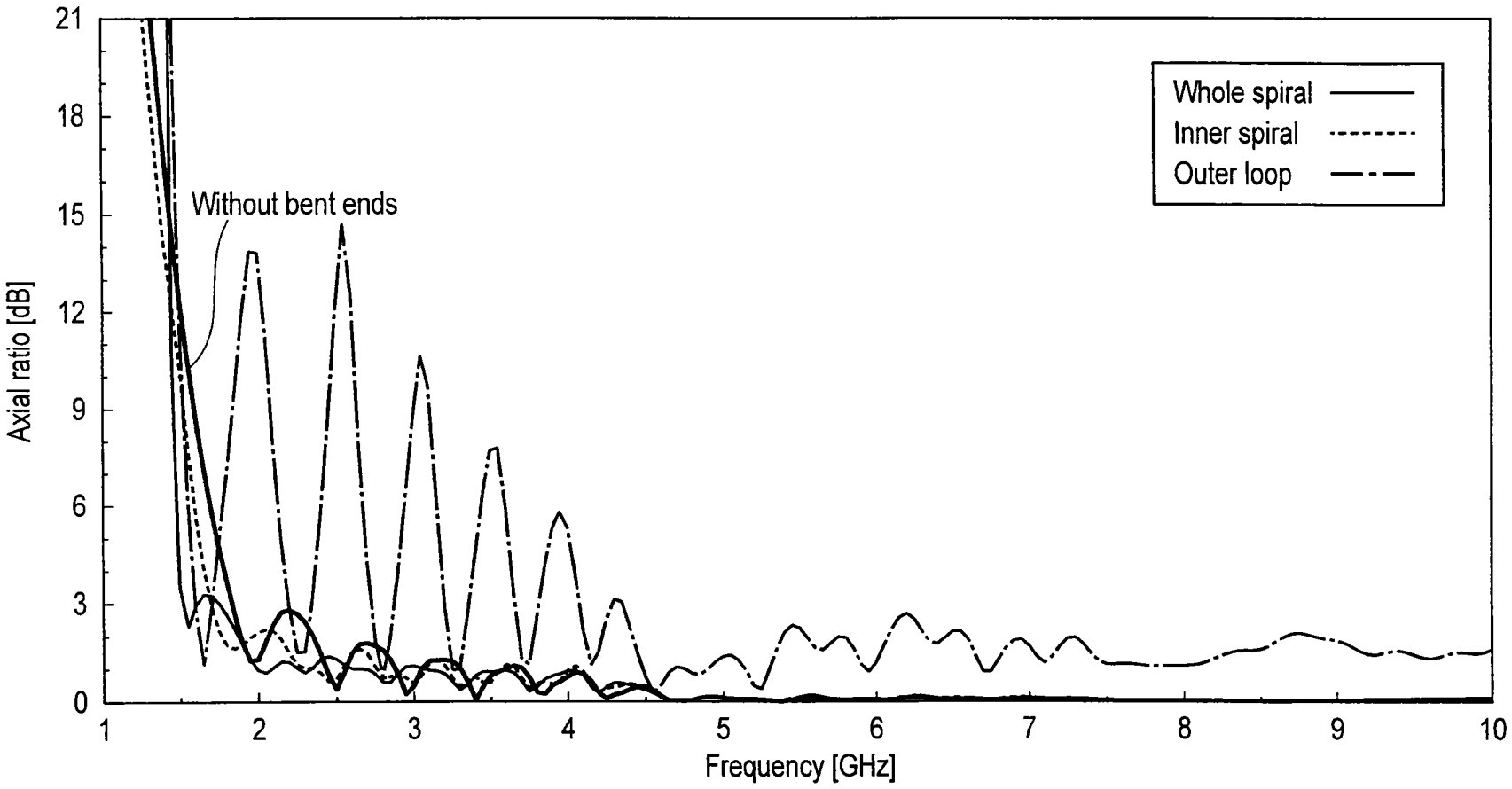
FIG. 14 is a graph showing the frequency characteristics of the axial ratios of the respective fields and the axial ratio without bent ends.

FIG. 14 is a graph showing the frequency characteristics of the axial ratios of the respective fields. Since at a frequency of 1.6 GHz or higher, the axial ratio characteristics of the outer loop radiated field deteriorate but little radiation occurs as described above, the axial ratio of the inner spiral radiated field is dominant. Within the frequency range from 1.5 GHz to 1.6 GHz, the LHCP component of the outer loop current and that of the inner spiral current cancel each other, thereby obtaining a satisfactory axial ratio for the whole spiral antenna.

Figure 15:
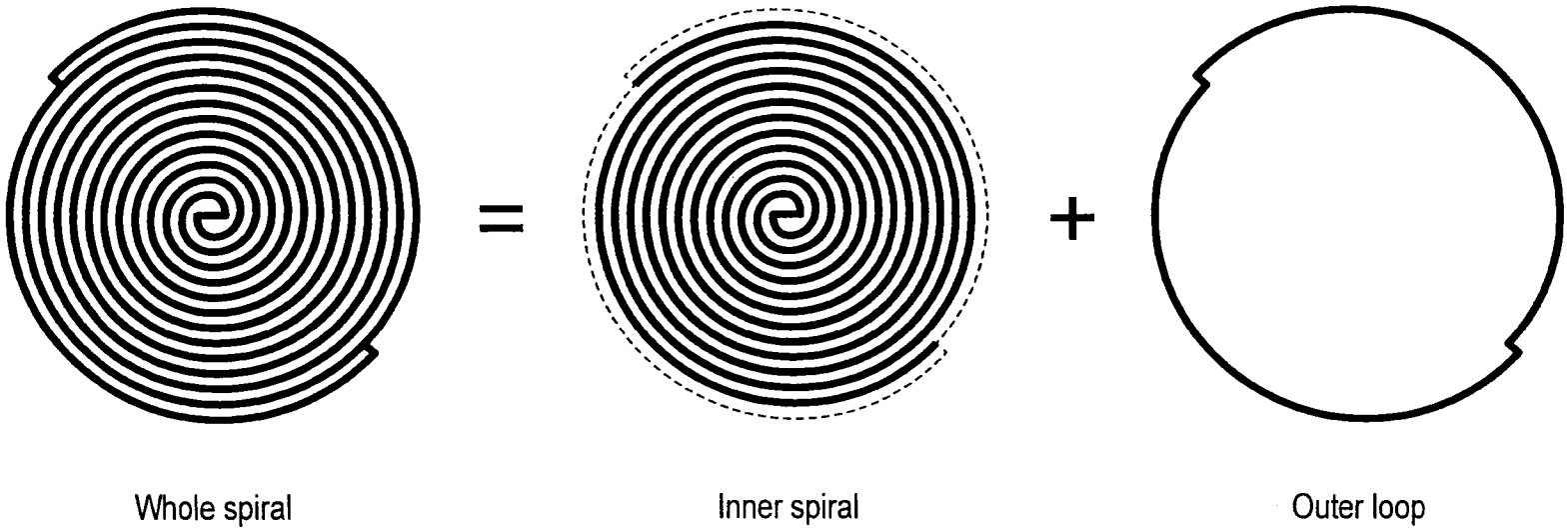
FIG. 15 is a view showing a case in which the whole radiated field from a strip spiral antenna is decomposed into respective fields according to the embodiment.

Note that spiral arms formed by strips also exhibit the same behavior as that of the spiral arms formed by wires. As shown in FIG. 15, the whole spiral radiated field is decomposed into an inner spiral radiated field and an outer loop radiated field, similarly to the above-described example.

Figure 16A:
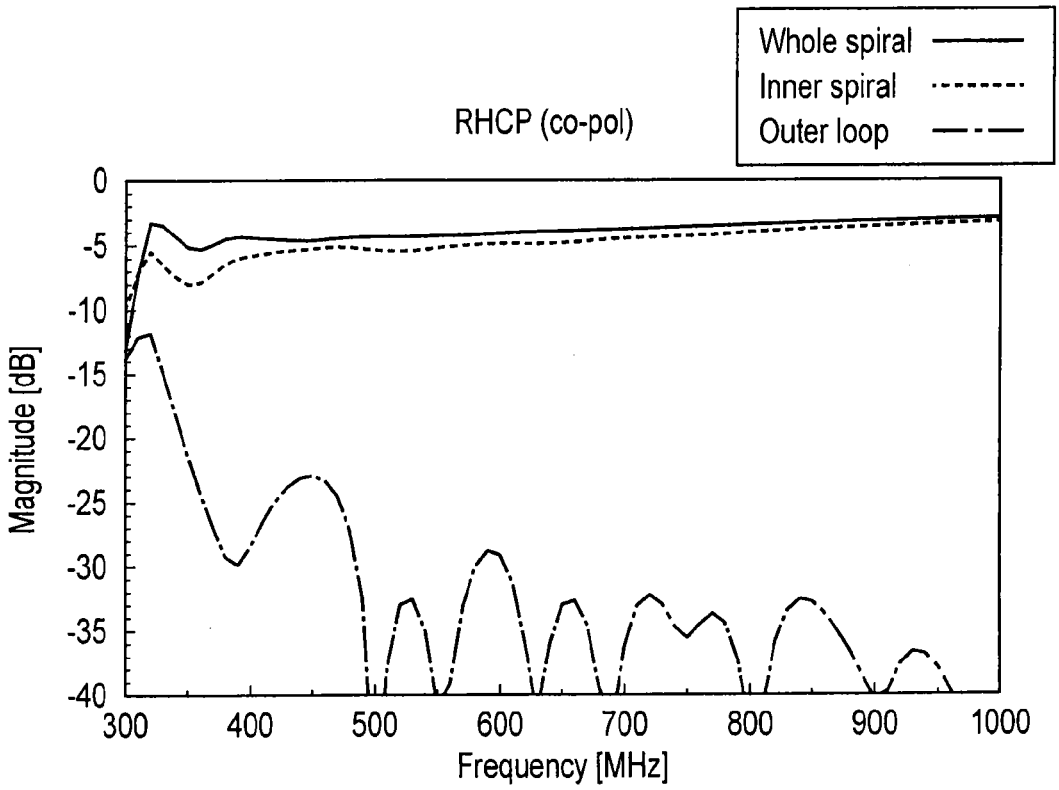
FIG. 16A is a graph showing the frequency characteristics of the amplitude of the RHCP component of each radiated field.
Figure 16B:
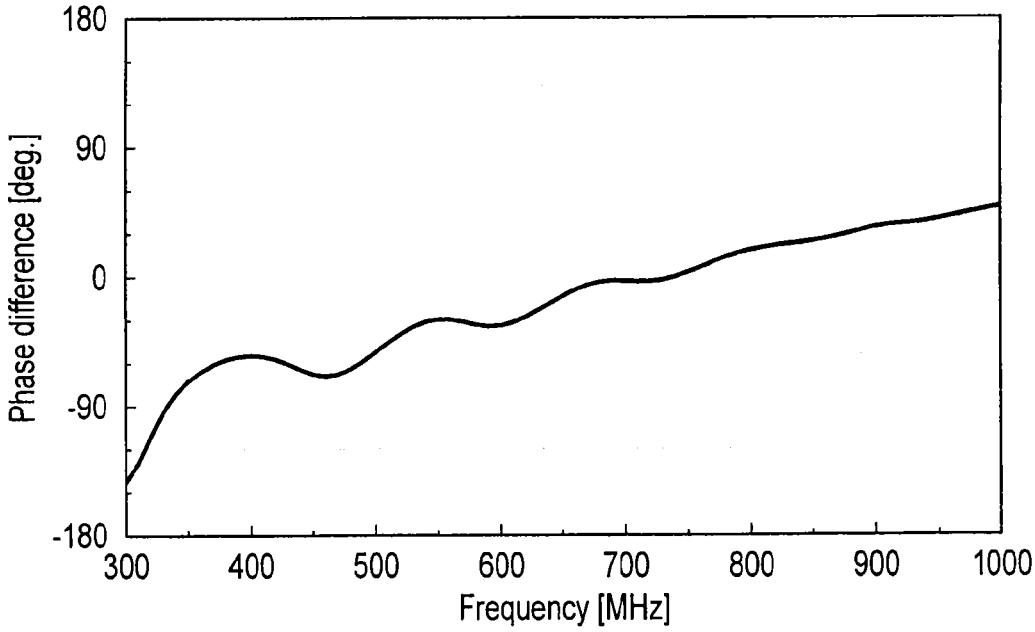
FIG. 16B is a graph showing the frequency characteristics of the phase difference between the RHCP component of an inner spiral radiated field and that of an outer loop radiated field.
Figure 17A:
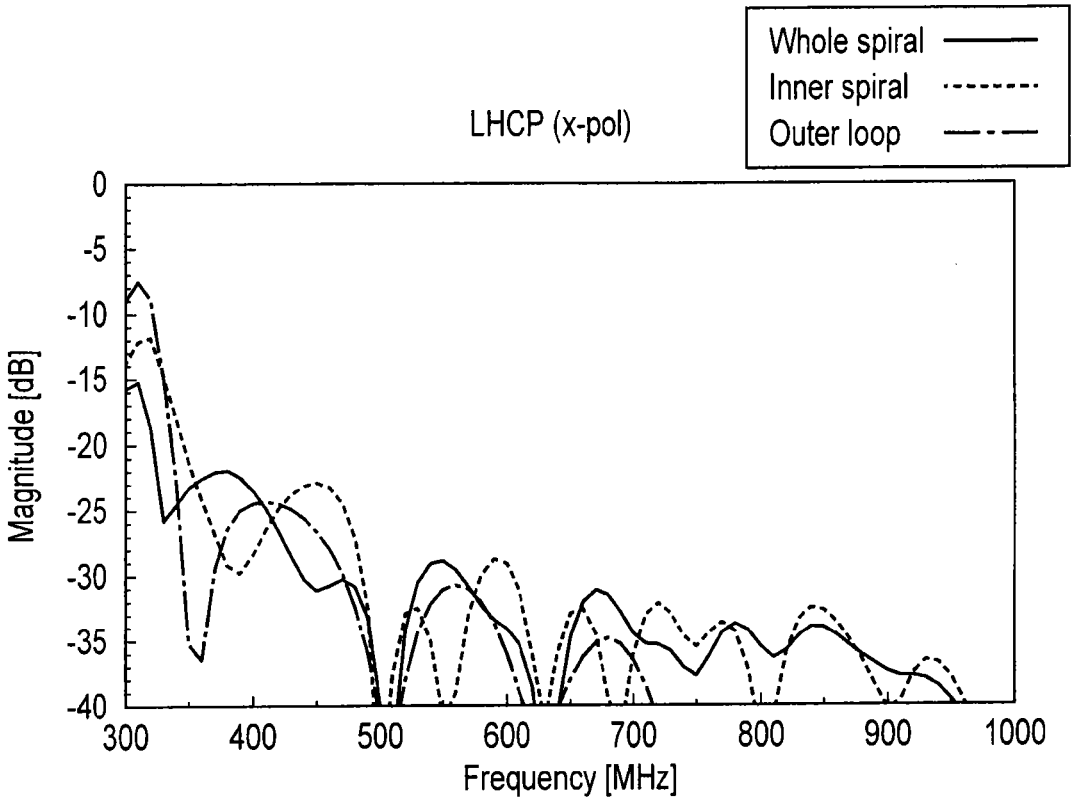
FIG. 17A is a graph showing the frequency characteristics of the amplitude of the LHCP component of each radiated field.
Figure 17B:
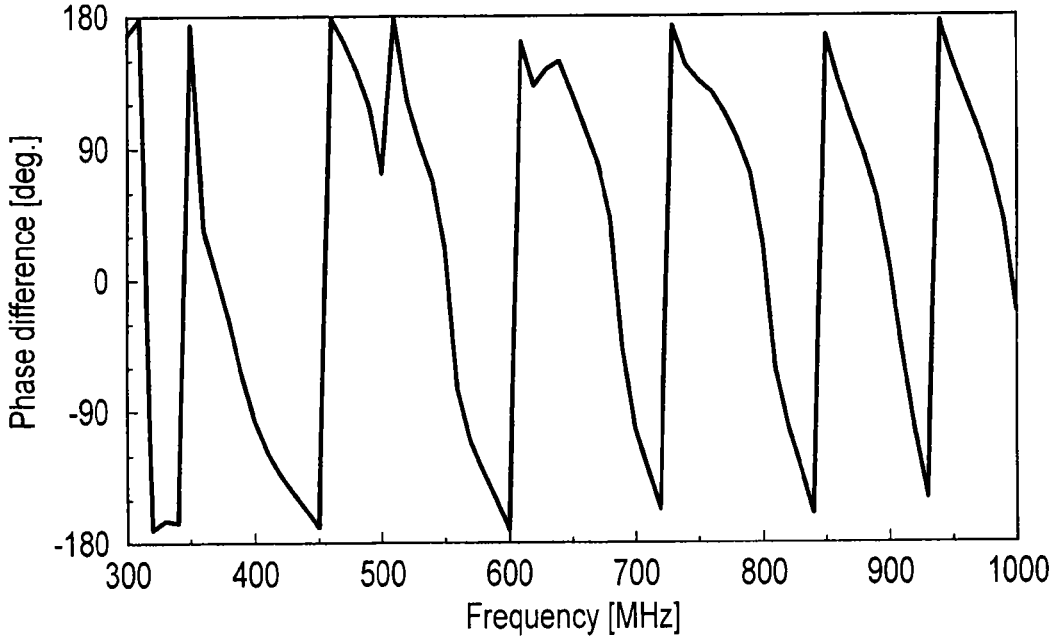
FIG. 17B is a graph showing the frequency characteristics of the phase difference between the LHCP component of the inner spiral radiated field and that of the outer loop radiated field.

FIG. 16A is a graph showing the frequency characteristics of the amplitude of the RHCP (right-handed circularly polarized wave) component of each radiated field. FIG. 16B is a graph showing the frequency characteristics of the phase difference between the outer loop radiated field and the inner spiral radiated field. FIG. 17A is a graph showing the frequency characteristics of the amplitude of the LHCP (left-handed circularly polarized wave) component of each radiated field. FIG. 17B is a graph showing the frequency characteristics of the phase difference between the outer loop radiated field and the inner spiral radiated field.

Obtaining a satisfactory axial ratio amounts to making one of the circularly polarized wave components dominant. Note that in this embodiment, the RHCP component is dominant. Referring to FIGS. 16A and 17A, at a frequency of 350 MHz or higher, the inner spiral radiated field is dominant. This means that as described above, the reflected current at the ends of the spiral arms has reduced by bending the ends, and a traveling-wave current has been generated.

Figure 18A:
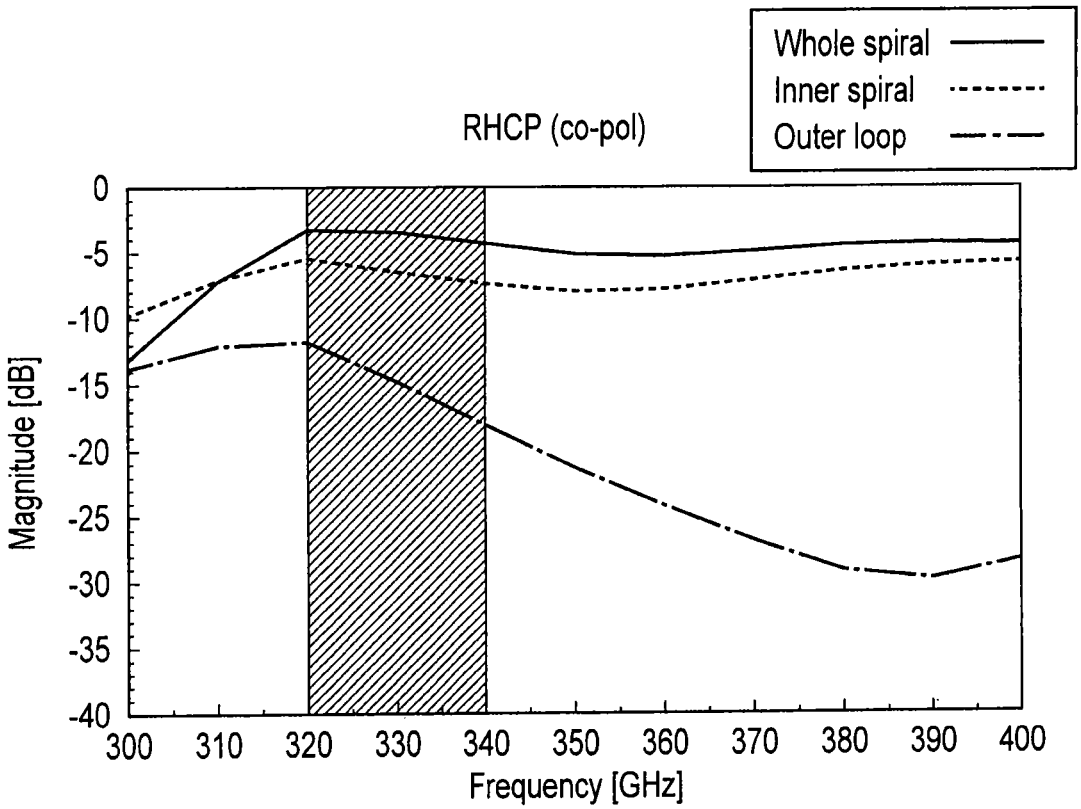
FIG. 18A is an enlarged graph showing the frequency range from 300 to 400 MHz shown in FIG. 16A.
Figure 18B:
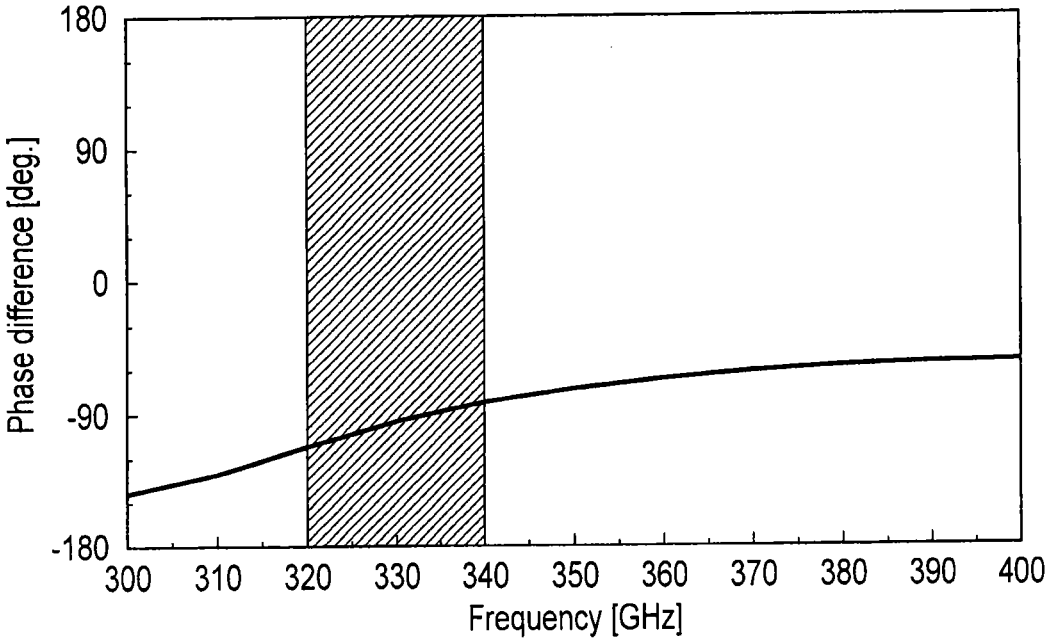
FIG. 18B is an enlarged graph showing the frequency range from 300 to 400 MHz shown in FIG. 16B.
Figure 19A:
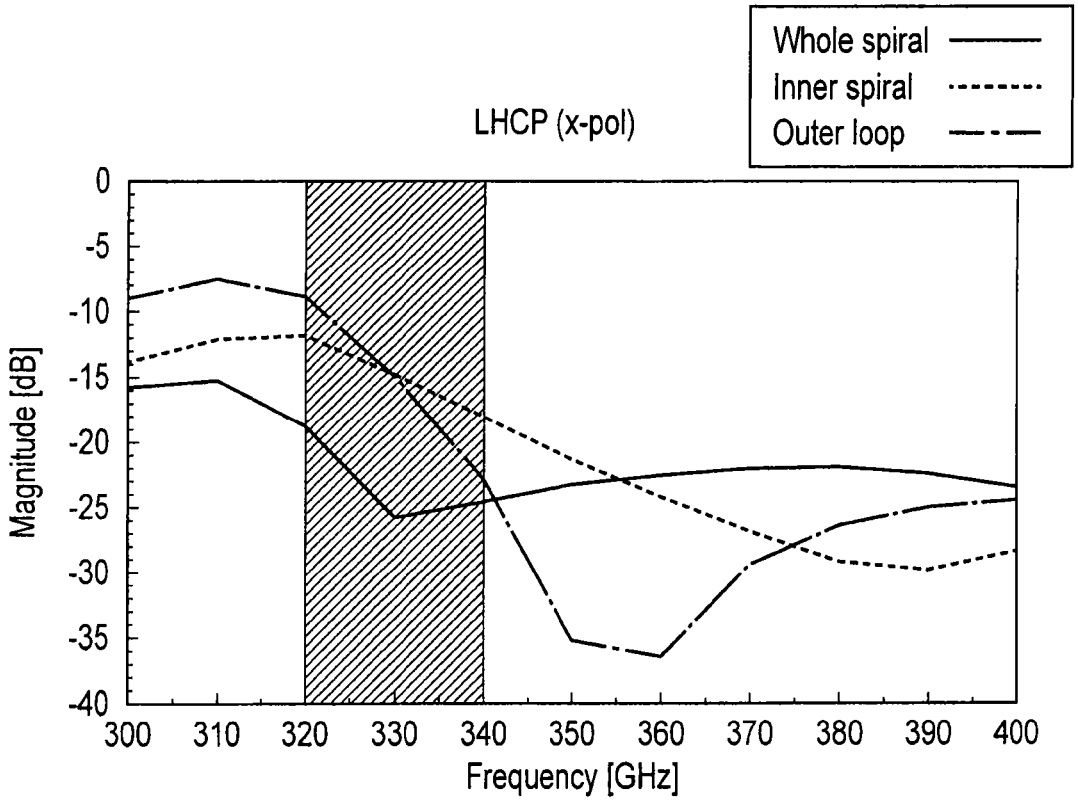
FIG. 19A is an enlarged graph showing the frequency range from 300 to 400 MHz shown in FIG. 17A.
Figure 19B:
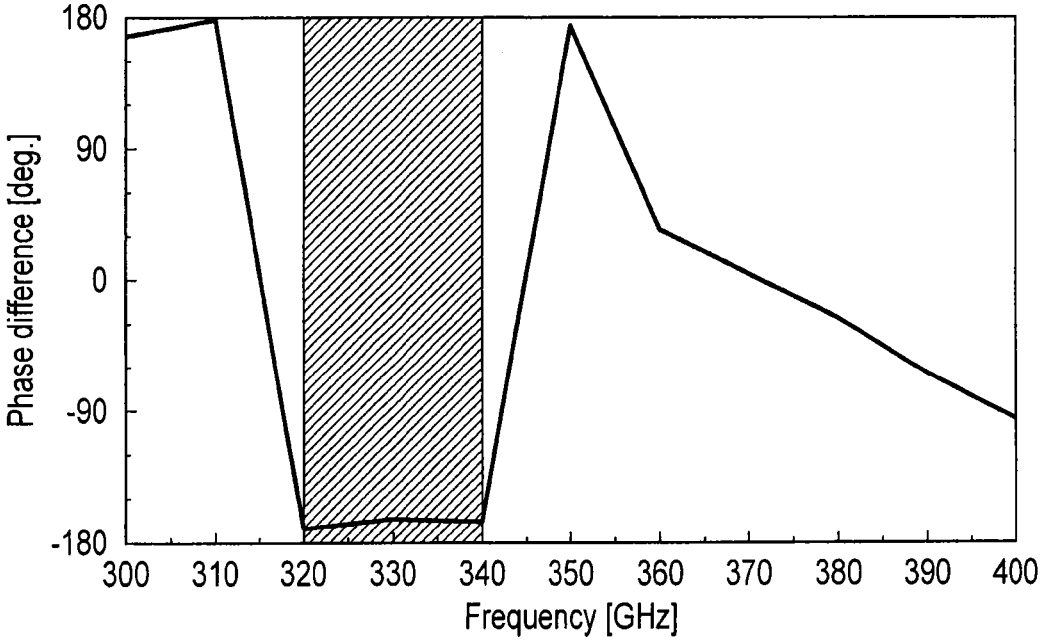
FIG. 19B is an enlarged graph showing the frequency range from 300 to 400 MHz shown in FIG. 17B.

Within the frequency range from 320 MHz to 350 MHz, the spiral arms exhibit a slightly different behavior. FIGS. 18A, 18B, 19A, and 19B are enlarged views showing the frequency range from 300 MHz to 400 MHz shown in FIGS. 16A, 16B, 17A, and 17B, respectively. As shown in FIGS. 18A and 19A, for not only the RHCP component but also the LHCP component, the strength of the outer loop radiated field is almost equal to that of the inner spiral radiated field within the frequency range from 300 MHz to 400 MHz. Referring to FIG. 19B, however, the phase difference between the LHCP components around a frequency of 330 MHz is 180°. Therefore, the LHCP component of the outer loop radiated field and that of the inner spiral radiated field cancel each other in space, and the total LHCP component is suppressed. Consequently, the RHCP component becomes dominant, thereby obtaining a satisfactory axial ratio. The gain characteristics improve since the LHCP components cancel each other, as a matter of course.

Figure 20:
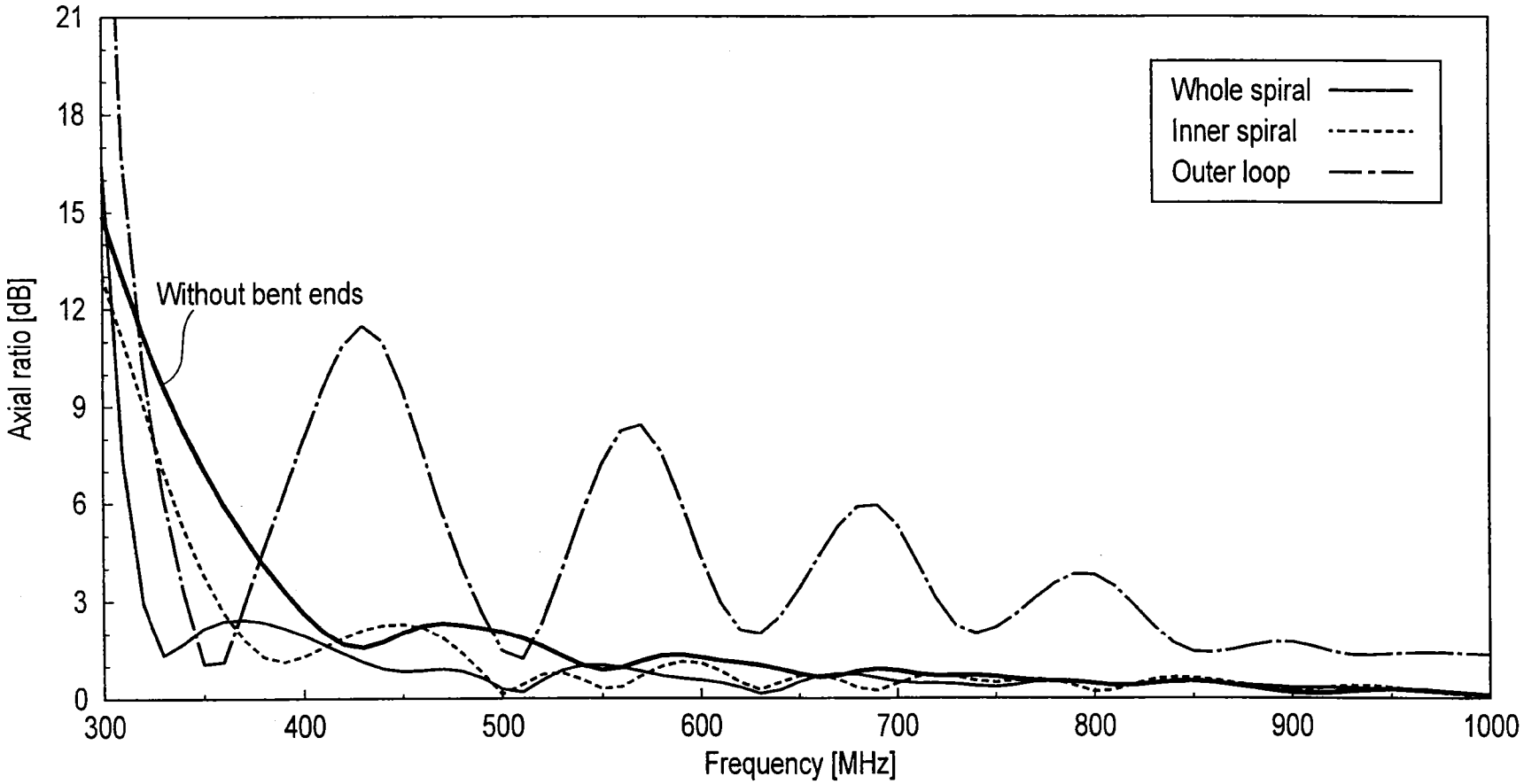
FIG. 20 is a graph showing the frequency characteristics of the axial ratios of the respective fields and the axial ratio without bent ends.

FIG. 20 is a graph showing the frequency characteristics of the axial ratios of the respective fields. Since at a frequency of 350 MHz or higher, the axial ratio characteristics of the outer loop radiated field deteriorate but little radiation occurs as described above, the axial ratio of the inner spiral radiated field is dominant. Within the frequency range from 320 MHz to 350 MHz, the LHCP component of the outer loop current and that of the inner spiral current cancel each other, thereby obtaining a satisfactory axial ratio for the whole spiral antenna. As described above, effects to be obtained are substantially the same regardless of whether the spiral arms are formed by wires or strips.

According to the embodiment, therefore, it is possible to reduce the reflected wave at the ends of the spiral arms by bending the ends, thereby improving the antenna characteristics (gain and axial ratio) in a low frequency band with a simple structure, and decreasing the size of the antenna.

(First Modification)

Figure 21:
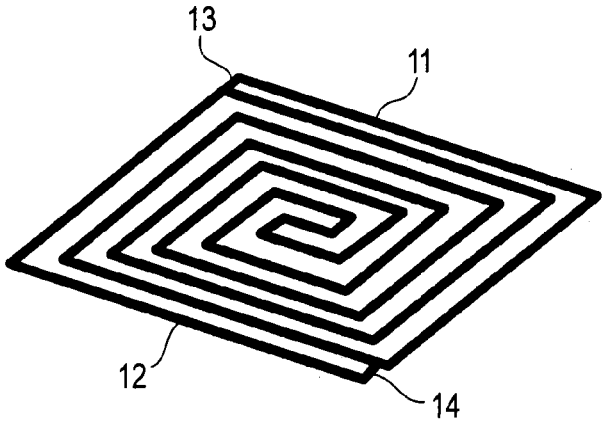
FIG. 21 is a perspective view showing a one point feed spiral antenna according to the first modification to the embodiment.

FIG. 21 shows a spiral antenna according to the first modification. Although a circular spiral antenna is used in the above-described embodiment, the spiral antenna need not have a circular shape. Even if the spiral arms have a polygonal shape such as a rectangular shape as shown in FIG. 21, it is possible to obtain the same effects as those in the above-described embodiment.

(Second Modification)

Figure 22:
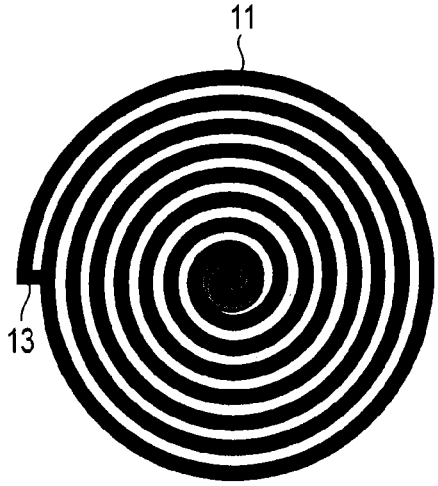
FIG. 22 is a plan view showing a spiral antenna according to the second modification to the embodiment.

FIG. 22 shows a spiral antenna according to the second modification. In the above-described embodiment, the spiral antenna includes two spiral arms and has a feed point at the center. As shown in FIG. 22, however, a spiral antenna may have one spiral arm. Even if a one-point feed spiral antenna is used as in the second modification, it is possible to obtain the same effects as those in the above-described embodiment.

(Third Modification)

Figure 23:
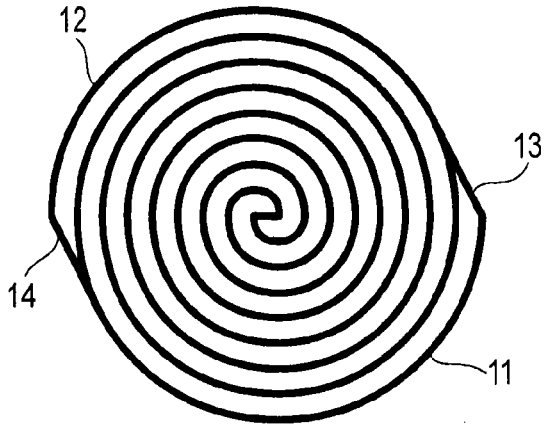
FIG. 23 is a plan view showing a spiral antenna according to the third modification to the embodiment.

FIG. 23 shows a spiral antenna according to the third modification. In the above-described embodiment, each of the connection portions 13 and 14 is bent at 90°. Even if each connection portion is bent at an angle other than 90° as shown in FIG. 23, it is possible to obtain the same effects. Furthermore, it is possible to obtain the same effects by combining the above-described first, second, and third modifications, as needed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A spiral antenna comprising:

at least one spiral arm; and a connection portion which connects an end of said spiral arm to an adjacent spiral arm, wherein at said connection portion, a current reflected by the end of said spiral arm and a current flowing to the adjacent spiral arm cancel each other.

2. A spiral antenna comprising:

at least one spiral arm; and a connection portion which connects an end of said spiral arm to an adjacent spiral arm, wherein when transmitting/receiving a right-handed circularly polarized wave, a left-handed circularly polarized wave of an outer loop radiated field of said spiral arm is canceled by a left-handed circularly polarized wave of an inner spiral radiated field of said spiral arm at a frequency at which a phase difference between the left-handed circularly polarized waves is substantially 180°.

3. A spiral antenna comprising:

at least one spiral arm; and a connection portion which connects an end of said spiral arm to an adjacent spiral arm, wherein when transmitting/receiving a left-handed circularly polarized wave, a right-handed circularly polarized wave of an outer loop radiated field of said spiral arm is canceled by a right-handed circularly polarized wave of an inner spiral radiated field of said spiral arm at a frequency at which a phase difference between the right-handed circularly polarized waves is substantially 180°.

* * * * *